US010250986B2

(12) United States Patent
Marrin et al.

(10) Patent No.: US 10,250,986 B2
(45) Date of Patent: Apr. 2, 2019

(54) MULTICHANNEL HEAD-TRACKABLE MICROPHONE

(71) Applicants: Matthew Marrin, Canyon Country, CA (US); Greg Morgenstein, Venice, CA (US)

(72) Inventors: Matthew Marrin, Canyon Country, CA (US); Greg Morgenstein, Venice, CA (US)

( * ) Notice: Subject to any disclaimer, the term of this patent is extended or adjusted under 35 U.S.C. 154(b) by 26 days.

(21) Appl. No.: 15/585,127

(22) Filed: May 2, 2017

(65) Prior Publication Data

US 2017/0347193 A1 Nov. 30, 2017

Related U.S. Application Data

(60) Provisional application No. 62/340,896, filed on May 24, 2016.

(51) Int. Cl.

| | |
|---|---|
| ***H04R 5/027*** | (2006.01) |
| ***H04R 1/04*** | (2006.01) |
| ***H04R 3/00*** | (2006.01) |
| ***H04R 1/40*** | (2006.01) |
| ***H04R 1/08*** | (2006.01) |

(52) U.S. Cl.
CPC ..... *H04R 5/027* (2013.01); *H04R 1/04* (2013.01); *H04R 1/083* (2013.01); *H04R 1/406* (2013.01); *H04R 3/005* (2013.01)

(58) Field of Classification Search
CPC ..... H04R 5/027; H04R 1/04; H04R 1/083; H04R 1/406; H04R 3/005
USPC ..... 381/26, 355, 361, 362, 363, 366
See application file for complete search history.

(56) References Cited

U.S. PATENT DOCUMENTS

| | | | | |
|---|---|---|---|---|
| 7,068,801 | B1 * | 6/2006 | Stinson | H04R 1/406 381/160 |
| 8,718,311 | B2 * | 5/2014 | Hilderman | H04R 1/026 381/362 |
| 9,400,341 | B2 * | 7/2016 | Mederos | G01V 8/10 |
| 2003/0160862 | A1 * | 8/2003 | Charlier | H04N 5/23238 348/14.08 |
| 2016/0219365 | A1 * | 7/2016 | Elko | H04R 3/005 |
| 2017/0105066 | A1 * | 4/2017 | McLaughlin | H04R 1/406 |
| 2017/0295429 | A1 * | 10/2017 | Poletti | H04R 5/027 |

* cited by examiner

*Primary Examiner* — Jason R Kurr
(74) *Attorney, Agent, or Firm* — Mark S Hubert

(57) ABSTRACT

A production work flow optimized multichannel virtual reality microphone that has its own rendering software allowing for the recording, rendering, and playing back of immersive, head-trackable positional audio for 360 video, gaming, and virtual reality applications. The multichannel microphone used to record multiple binaural sound perspectives, has eight microphones coupled to a rotatable disc frictionally mounted on the outside of a truncated spherical shell, an internal, detachable clamp for attaching the shell to a vertical pole stand, and easily accessible microphone output connections configured as four stereo microphone pairs, spaced closely to an average set of human ears. The microphone output connections are located on an internal support member. These are accessible through upper and lower lids and a door. Four small baffles simulating the pinna of the human ear reside on the disc, separating the paired microphones.

18 Claims, 8 Drawing Sheets

2A

MULTICHANNEL HEAD-TRACKABLE MICROPHONE

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to microphone technology, and more particularly to a microphone for virtual reality, 360 video, gaming, music recording, acoustics, architectural space captures and traditional video and film content production.

BACKGROUND

Currently there are a number of multichannel microphone solutions for recording sound for 360 video or virtual reality applications. Some of these solutions attempt to record sound for use in various production situations, but these solutions fail to meet the needs of the industry because of the physical nature of the microphone enclosures. Simply stated, the existing multichannel microphones do not fit into the workflow dynamics that exist in an audio/video production process.

Some of the currently available multichannel microphones do not easily integrate with camera systems. They get in the way of the video camera's field of view rendering the microphones unusable. Other multichannel microphones attempt to record sound for various production situations, but these solutions are similarly unable to meet the needs of the industry because they lack companion software to render the recorded sound. Still other multichannel microphones seek to record immersive sound for various productions, but fail to meet industry needs because they only record sound from one perspective and cannot be head-tracked in 360 video or virtual reality applications. Lastly, existing microphone systems are cumbersome and slow to install on pole stands.

It would be desirable to have a multichannel microphone that records an immersive sound field for 360 videos and virtual reality content that fits into the production work flow with mounting capabilities that doesn't obstruct the cameras. Furthermore, it would also be desirable to have a means to render and play back recorded sound from a multichannel microphone based on head-tracking data from a 360 video or virtual reality end user. Still further, it would be desirable to have a production work flow optimized multichannel microphone paired with positional audio rendering software to solve such problems.

Henceforth, an improved production work flow optimized multichannel virtual reality microphone that has its own rendering software to create a complete solution for recording, rendering, and playing back immersive, head-trackable positional audio for 360 video, gaming, and virtual reality applications would fulfill a long felt need in the audio recording industry.

This new invention utilizes and combines known and new technologies in a unique and novel configuration to overcome the aforementioned problems and accomplish this.

BRIEF SUMMARY

In accordance with various embodiments, a multichannel microphone for recording sound for 360 video or virtual reality applications that approximate the sound heard by a human is provided.

In one aspect, an eight microphone spherical housing configured with four microphone pairs, with each microphone in the pairs separated by a baffle to simulate the human pinna, and each pair positioned at 90 degrees apart about the exterior of a spherical shell approximating the human head, is provided.

In another aspect, a multichannel microphone that records sound that can be processed through speakers to simulate the placement of an auditory cue in a virtual 3D space.

In another aspect, a human head sized microphone shell providing options for 360 sound recording via eight omnidirectional microphones, capable of capturing sound from the full 360 degrees of the horizon, including the view points of front, left, rear, right, and all points in between those perspectives.

It is still further an objective of the present invention to create a durable, easy to manufacture, easy to repair, affordable device that represents a complete system for recording, rendering, and delivering immersive dynamic positional sound that is packaged in a simple to use, point and shoot solution.

In yet another aspect, an eight microphone, spherical shell is provided with 8 mono, 4 stereo, 2 four channel, or 1 eight channel microphone output connections, providing recorded outputs that that may be algorithmically crossfaded according to the horizontal or azimuth rotational position of a companion device.

It is yet another objective of the present invention to provide a multichannel microphone that integrates with its separable, quick release-clamping device.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
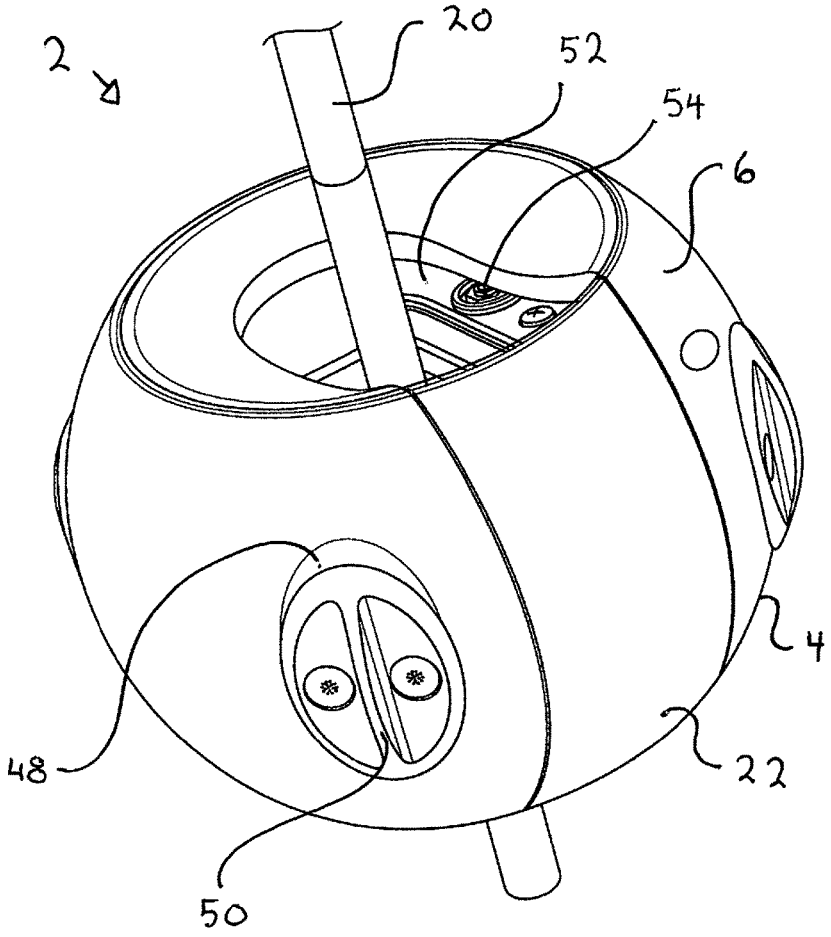
FIG. 1 is a front perspective of the multichannel microphone affixed to a microphone stand.

While various aspects and features of certain embodiments have been summarized above, the following detailed description illustrates at least on exemplary embodiment in further detail to enable one skilled in the art to practice such an embodiment. The described example is provided for illustrative purposes and is not intended to limit the scope of the invention.

In the following description, for the purposes of explanation, numerous specific details are set forth in order to provide a thorough understanding of the described embodiment/s. It will be apparent to one skilled in the art, however, that other embodiments of the present invention may be practiced without some of these specific details. While various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein the term "binaural" means used with both ears. Binaural recording refers to recording done with at two microphones the sound of which is delivered separately to the two ears.

As used herein the term "pinnae" refers to the external part of the ear in humans and other mammals. (Also called the auricle.)

As used herein the term "inter aural effect" refers to the combination of the interaural time differences (ITD) and interaural level differences (ILD) that are used by the human auditory system to interpret sound localization.

As used herein the term "head trackable microphone device" refers to a recording device made of a series of spaced microphones, each the same distance from a central point, that record at various azimuth (horizontal) degrees.

As used herein the term "locking means" refers to any of a plethora of mechanical fastening devices such as pins, nuts and bolts, spring loaded protrusions and matingly corresponding detents, hooks, eyelets, engageable tabs and slots, and equivalents such as is well known in the art, that attach the support members of the shell to the clamp.

As used herein the term "adjustable tightening means" refers to any of a plethora of mechanical mechanisms to connect the two free ends of the clamp arms that can advance the jaws of a clamp toward each other so as to provide sufficient gripping pressure to retain the clamp in a specific location on a pole stand. This includes such mechanisms as springs, threaded thumbscrews, bolts, lever arm or cam arm rods, and equivalents such as is well known in the art.

As used herein the term "clamp lock means" refers to any of a plethora of mechanical fasteners including threaded members (set screw, bolt, arm, etc.) passing through threaded orifices, expandable tab and slots, pins or lock rings and orifices, protrusions and detents and their equivalents.

As used herein the term "microphone output connector" refers to the mechanical coupler that directs the microphone electronic output for the microphones. Although referred to in general terms throughout most of this specification with one microphone output connector used per microphone, it is known that multiple microphone electronic outputs (for example four) may be combined in a single microphone output connector. In the preferred embodiment there are but four microphone output connectors for the eight microphone electronic outputs.

The present invention relates to a novel design for a multichannel head trackable microphone. Integral to the system is quick release clamp that is independently attached to a pole stand via its adjustable (preferably spring loaded) locking means. The physical design of the shell of the microphone allows the microphone to be quickly slid onto the clamp and affixed onto the pole. Various microphones with their sound baffles, are positioned horizontally along the exterior face of a shell at various azimuth from the midpoint of the shell. In this way they can be used for binaural recording. The output from the various microphones may be arranged in different channel groupings (1, 2, 4 or 8 channels) and their output sent to a processing means.

The processing means applies an algorithmic program to crossfade (blend) the various microphone outputs that are sent to a set of speakers in some form of a 360-degree listening environment. (This may be a room, theater, headset etc.) The algorithm applied is based on a relational database that determines the crossfading based on the azimuth location of an indicating device (such as a headset or a video camera.) This results in a recorded audio track played to the listening environment so as to sound like what a listener at that location would hear in accordance with the turning of their head about a predetermined axis thereof, thus, simulating a real-life listening environment from a model thereof.

Sound localization refers to a listener's ability to identify the location or origin of a detected sound in both direction and distance. The crossfading of the recorded sound by the processing means as the 360 audio/visual device is moved in azimuth about the center of the listener's head, allows the speakers to output sound, capable of accommodation human sound localization in conjunction with displayed video on the device. (This video is also cued to the azimuth movements of the user's head.)

The primary indicators of sound localization are time and level differences (or intensity-difference) between both ears. These are known as interaural time differences (ITD) and interaural level differences (ILD). The azimuth of a sound is signaled by the difference in arrival times between the ears (ITD) and by the level of the sounds (ILD). The ILD is affected by spectral reflections of the sound from body parts such as the head (shadow effect) and the pinnae (pinnae filtering effect). The head acts as a barrier to change the sound's timbre, intensity, and spectral qualities. These two factors affect the ILD and ITD.

Since human ears are on different sides of the head, with different positions in space, they are able to distinguish ITD and ILD. For this reason, and to mimic what a human hears, the binaural microphones are located on a shell sized and shaped similar to a human head that has baffles adjacent them to simulate the pinnae. The microphone pairs can thus record binaural sound close to what a human experiences as four human heads in one microphone that captures all four perspectives at once.

Looking at FIG. 1 it can be seen that the multichannel head trackable microphone 2 is a shell 4, housing four discs 48 on its outer surface that each hold a baffle 50 and a pair of microphones and an adjustable pole clamp 62 releasable mounted on the inside volume 11 of the shell 4.

The shell 4 is a truncated spherical body bounded by upper and lower parallel, horizontal planes that intersect the sphere 4 above and below its horizontal centerline. In the preferred embodiment these two planes are equidistant from the midpoint of the spherical body. The shell 4 is thus a convex cylinder that is open at both its distal and proximal ends. It has this low profile to minimize visual obstruction to cameras. (Although depicted as a circular cylinder it is known that it may have a plethora other geometric cross sections such as Cartesian, hexagonal, octagonal, etc.) Its outer surface's coating has a matte finish similar to that of human skin. Optionally, it may have a thin coat of a low durometer polymer that approximates human flesh (something in the 10-60 durometer range as measured by the Shore 00 Type Durometer Scale.) This may be silicon. (The durometer of the shell 4, baffles 50 and discs 48 may be adjusted so as to approximate the human head, pinnae and ear canal. In this way the diameter of the shell 4 may be reduced to less than that of the average human head and still retain the binaural effect.) This spherical shape mimics the shadow effect of the human head. Although not depicted in all figures, the shell 4 of the microphone 2 may be fabricated in two substantially similar joinable halves.

Figure 2:
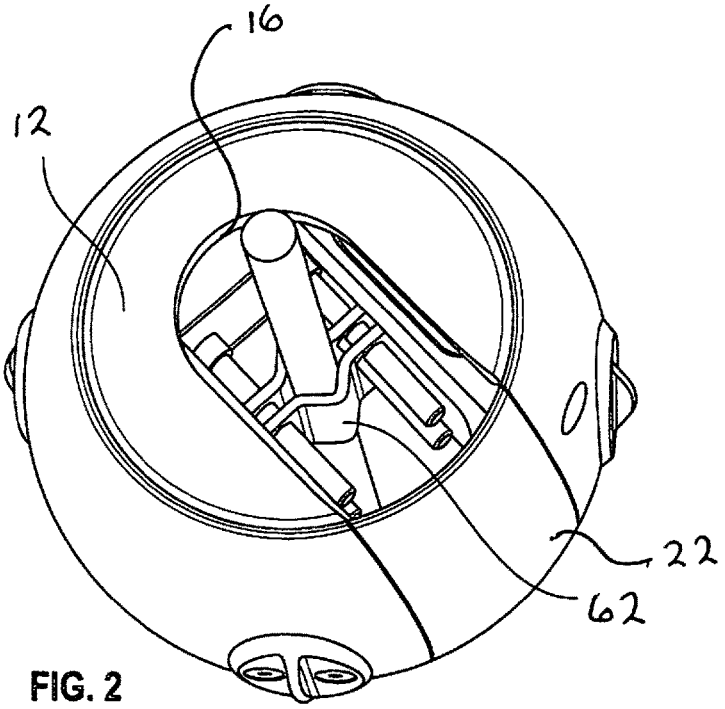
FIG. 2 is a top perspective view of the multichannel microphone affixed to a microphone stand.
Figure 3:
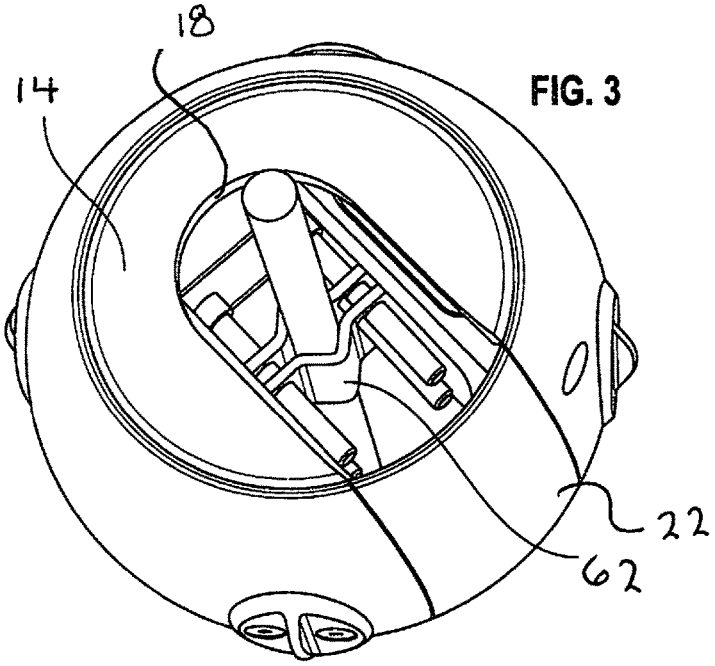
FIG. 3 is a bottom perspective view of the alternate embodiment multichannel microphone affixed to a microphone stand.
Figure 6:
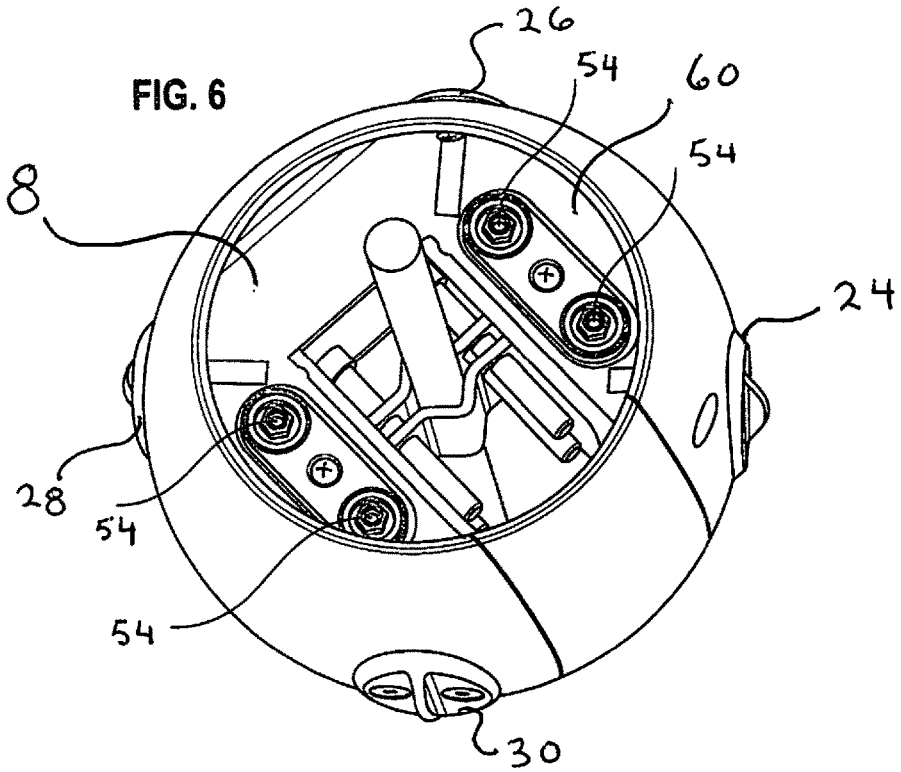
FIG. 6 is a top view of the alternate embodiment multichannel microphone affixed to a vertical pole stand.
Figure 7:
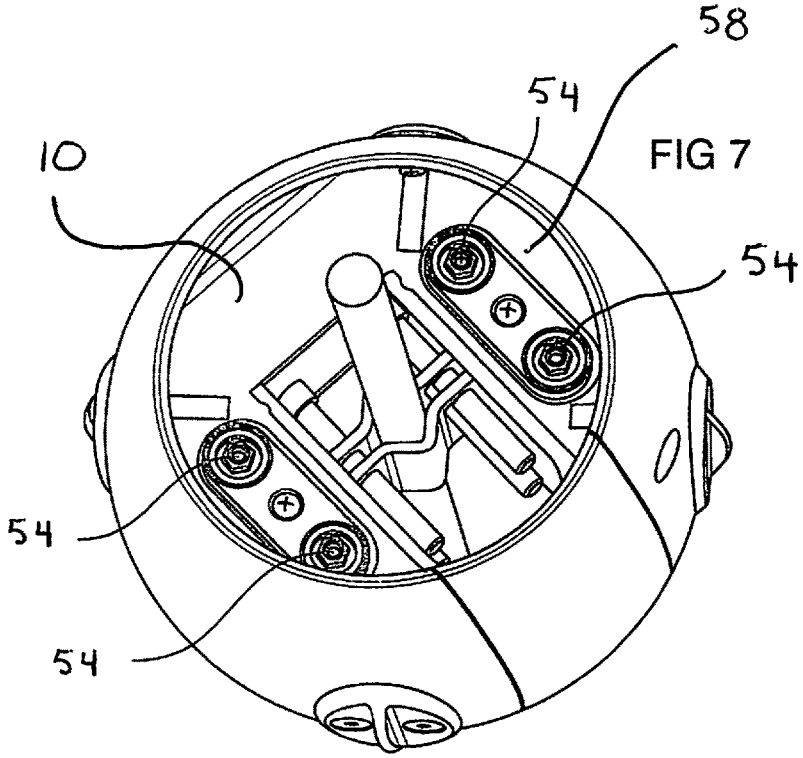
FIG. 7 is a bottom view of the multichannel microphone affixed to a vertical pole stand.

Looking at FIGS. 6 and 7, it can be seen the sections cut by the upper and lower planes define upper cutout region 8 and lower cutout region 10 (each geometrically known as small circles) and allow access to the interior of the shell. There is a top lid 12 (FIG. 2) and bottom lid 14 (FIG. 3) that attach to the shell 4. Each have a opening 16 and 18 that allow the passage of a pole stand 20 with the attached clamp 62 through the midpoint of the shell (via the door) as well as the passage of electronic cables from the inside volume 11 of the shell to the exterior. This includes camera cable pass through. In the preferred embodiment, these top and bottom lids 12 and 14 are substantially similar. The shell 4 is never fully enclosed. Between the upper and lower cutout regions 8 and 10 there is a vertical slot 21 with removable vertical door 22 having a width greater than that of the closed clamp 62, to allow its placement about the pole stand 20 and to also allow access to the shell's interior. The door 22 and lids 12 and 14 are all removable and are held in place by magnetic catches (not illustrated).

Figure 14:
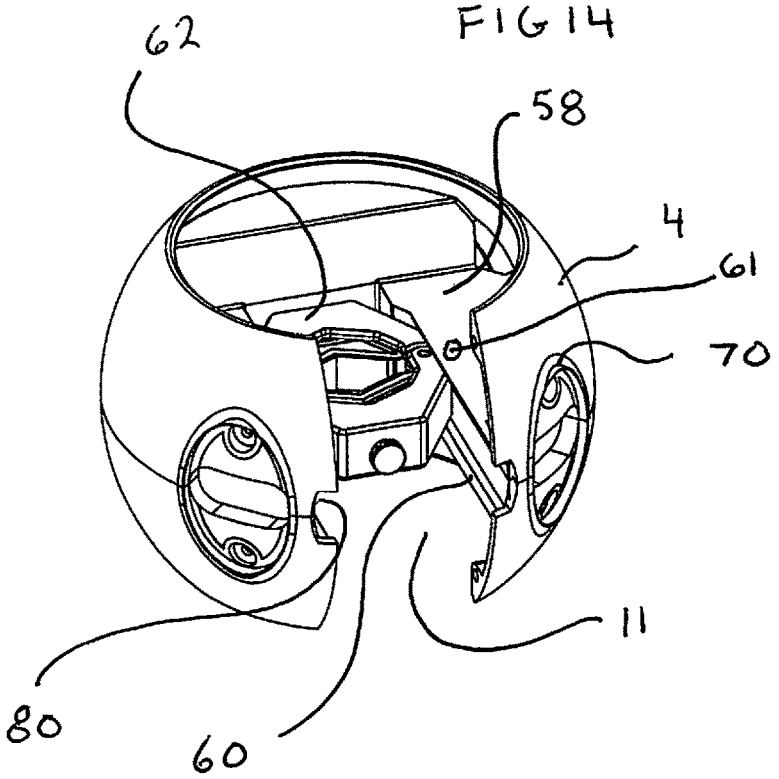
FIG. 14 is a top perspective view of the shell.
Figure 15:
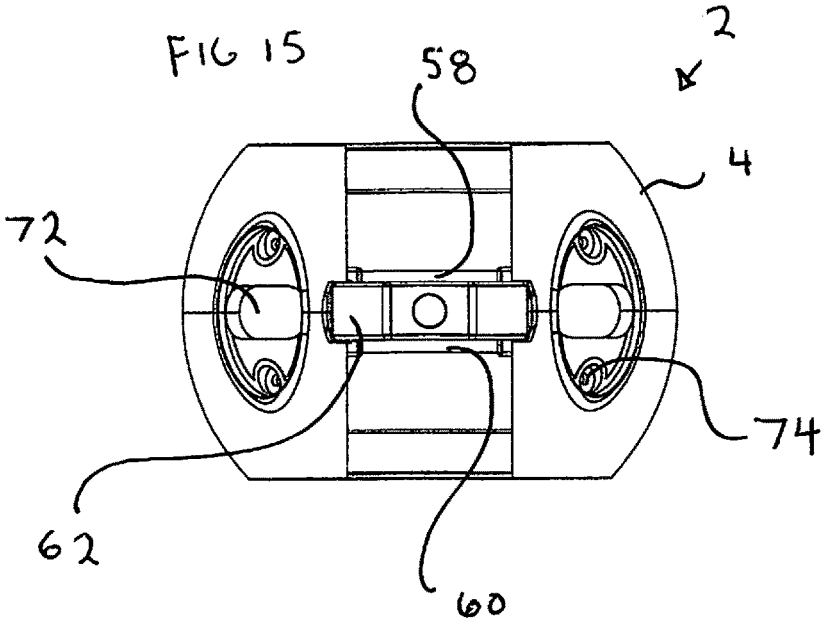
FIG. 15 is a front view of the multichannel microphone.

Looking at FIGS. 14 and 15 it can be seen that the shell 4 has four equidistantly spaced disc recesses 70 with a central orifice 72 and two mounting orifices 74 formed thereon, spaced along the midline of the sphere 4. These disc recesses 70 house the discs 48 which house the baffle 50 and dual microphone 2. The central orifice 72 allows the passage of the microphone connectors from the outside of the sphere 4 to the inside volume 11 of the sphere 4. The mounting orifices 74 allow mechanical fasteners to be affixed to the disc 48 to hold it and its components on the shell 4. As noted herein there may be rubber of foam affixed between the microphones and the disc 48 and or between the disc 48 and the recess 70. In alternate embodiments, the back of the disc 48 (not shown) has multiple ports for active engagement with the mechanical fastener such that it may be angularly adjusted.

Figure 4:
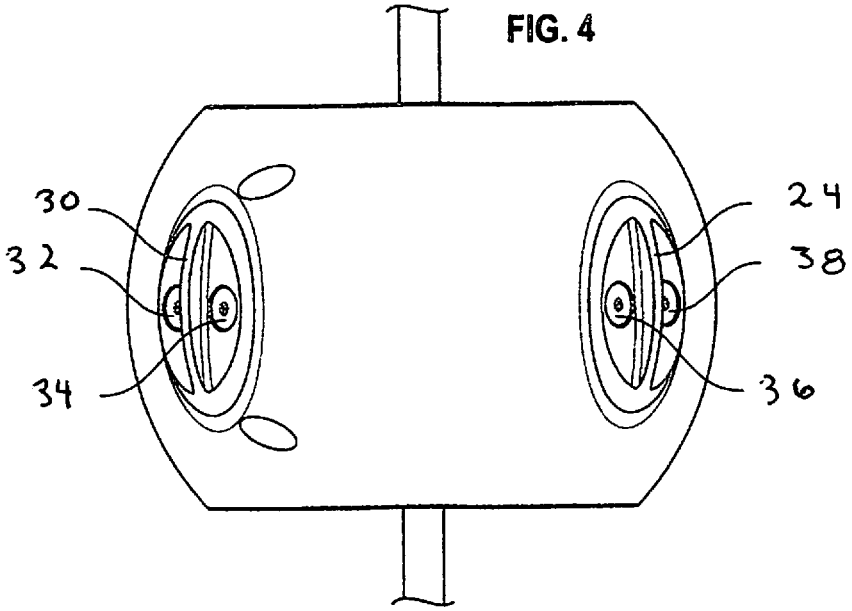
FIG. 4 is a first side perspective view showing a first one half of the multichannel microphone affixed to a microphone stand.
Figure 5:
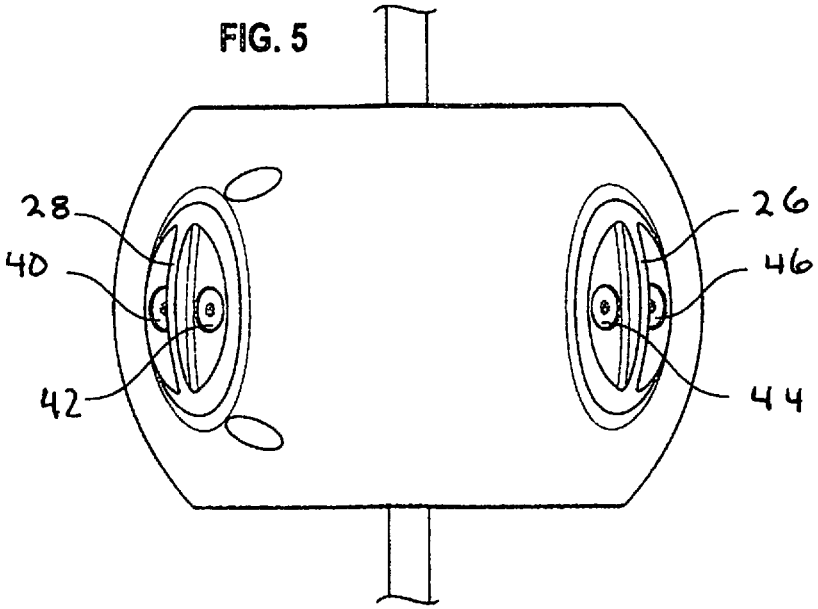
FIG. 5 is a second side perspective view showing a second half of the multichannel microphone affixed to a microphone stand.

Looking at FIGS. 4 and 5, it can be seen that there are eight microphone capsules (microphones) chosen from the set of microphones having directionality or polar patterns selected from any of the polar patterns from the set of polar patterns including omnidirectional, cardioid, subcartiod, hypercartoid, supercartiod or shotgun or bidirectional (figure of eight) arranged at 90 degree azmiuth spacings about the exterior face of the shell 4. The preferred embodiment uses omnidirectional, sub-cardioid or bidirectional polar patterns. These are in four microphone pairs 24, 26, 28 and 30 (FIG. 6) about the centerline of the exterior surface of the shell 4. The two microphones of each pair 32 and 34 of pair 30, 36 and 38 of pair 24, 40 and 42 of pair 28, and 44 and 46 of pair 26 (FIGS. 4 and 5) reside on substantially similar raised profile discs 48 projecting slightly above the surface of the shell 4. The raised profile discs are frictionally fitted into matingly sized orifices in the shell 4. In the preferred embodiment these discs 48 are rotatable through 90 degrees. In the center of the discs 48 extending normally from the surface of the disc 48 and the shell 4, resides an adjustable semi or partially elliptical vertical baffle 50 that simulates the tragus. In the preferred embodiment, the disc 24 is elliptical or circular (like the human pinnae is shaped) although other generic shapes may be utilized. The microphone capsules are imbedded in rubber or foam in the disc 48 and attached to the wall of the shell 4 to decouple each individual microphone capsule from the shell 4. These 4 decoupling areas prevent external nose or movement to be picked up by the microphone capsules in the recording.

The baffle 50 is shaped and positioned centered between the microphones so as to approximate the pinnae filtering effect caused by the pinnae. The baffle 50 and the discs 48 also have a matte finish and also optionally are fabricated from a low durometer polymer (0 to 40 in the Shore Type 00 Durometer Scale) such as silicon. (However it is envisioned that the baffle may be fabricated from a lower durometer polymer that that on the outer face of the shell or the discs 48.) The purpose of the discs 48 and baffles 50 is to affect the sound reaching the pair of microphones in the same manner as the pinnae and ear canal. The microphone baffles 50 may be adjusted by rotating the disc 48 about the face of the shell 4.

Since the human ear can't determine time or level differences existing for sounds originating along the circumference of circular conical slices where the cone's axis lies along the line between the two ears, adjustability of the baffle 50 may be utilized to resolve the location of a sound using interaural time differences and interaural level differences. This is the equivalent to tilting the head.

On the shell's interior volume 11 there is a pair of internal support members 58 and 60 (FIGS. 1, 14 and 15) that serve three purposes. They house the microphone output (which are operably connected to the microphones) s 54, stabilize the shell 4 about the clamp 62 (FIGS. 2, 3, 9 and 10) and form a horizontal clamp slot 52 to accept the clamp 62. The upper support member 58 and lower support member 60 are spaced parallel and apart from each other on the interior of the shell 4 so as to form this clamp slot 52 there between that is generally planar, horizontal and matingly sized for engagement about the clamp 62. In alternate embodiments there is but one inner support member that forms the equivalent of internal support members 58 and 60, having a clamp slot 52 therein.

The preferred embodiment differs from the alternate embodiment in the location of the microphone output connectors 54. In the preferred embodiment all eight of the microphone output connectors 54 reside on the bottom support member 60 so as to be accessible through the bottom lid 14 while in the alternate embodiment half of the microphone output connectors 54 are on the a first support member 58 and half on the second support member 60. As discussed herein, the actual number of microphone output connectors may vary by design although there will be eight microphone electronic outputs.

Figure 8:
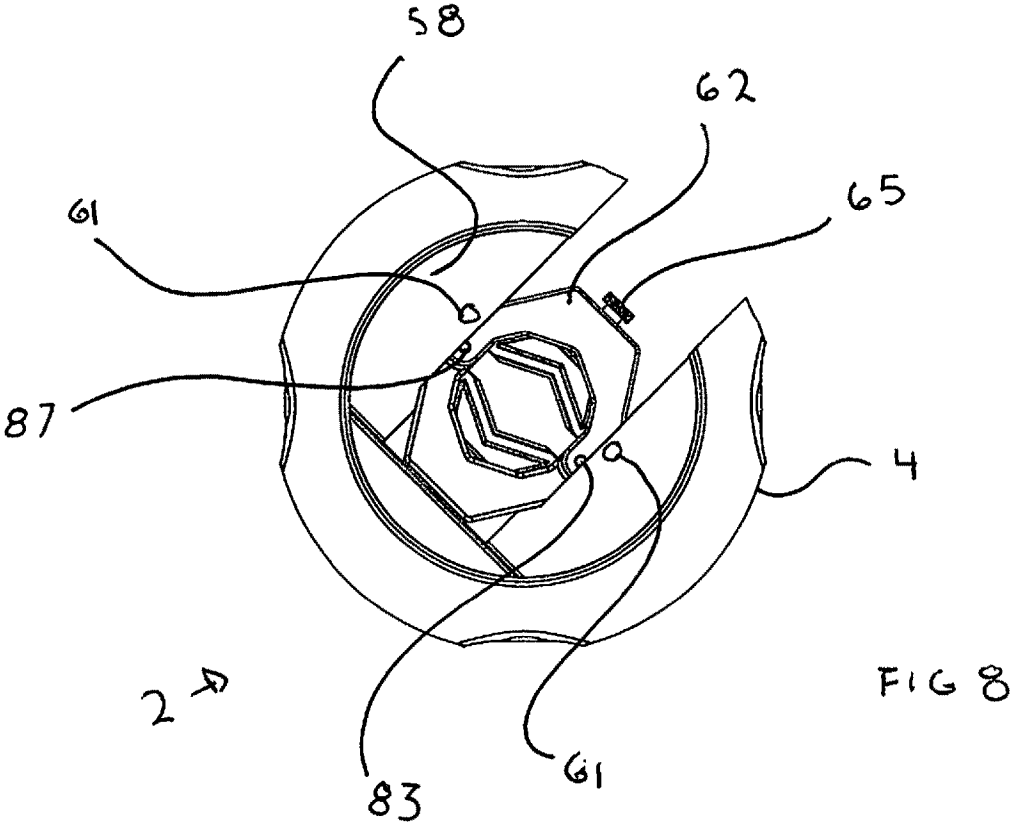
FIG. 8 is a top view of an adjustable pole clamp.

Looking at FIGS. 8 and 14, it can be seen that the clamp 62 is separable from the shell 4. The internal support members 58 and 60 are spaced so as to form a clamp slot 52 centered about the horizontal centerline of the shell 4. This slot 52 has an opening aligned with the approximate center of the vertical door slot 21. When the door 22 is removed the clamp 62 may be matingly received in its entirety within the slot 52. The clamp 62 may then be attached to the support members 58 and 60 by at least one of a pair of locking means 61, thus stabilizing the shell 4 to the pole stand. The clamp lock means 61 shown in FIG. 14 is a threaded mechanical fastener (set screw) threadingly engaged with a threaded orifice in the first support member 58, extending between the inner support members and the clamp 62 for frictional engagement of said clamp.

The clamp lock means could be substituted with any of a plethora of mechanical fastening devices such as pins, nuts and bolts, spring loaded protrusions and matingly corresponding detents, hooks, eyelets, engageable tabs and slots, and equivalents to the set screw, such as is well known in the art.

Looking at FIGS. 10-13—the clamp 62 can best be explained. This clamp 62 is intended for attachment to what has been referred to as a pole stand. A pole stand herein is defined as a microphone stand, light stand, C-stand, tripod, camera stand, laptop stand, background stand, and the equivalent. The clamp 62 can attach to any stand with a diameter ranging from ⅛" or less all the way up to 3" in diameter. The clamp 62 has two opposably moveable Vee shaped jaws 69 that have gripable polymer faces 63. In the preferred embodiment one of the jaws 69 is advanced toward the other jaw 69 by the adjustable tightening means 65 to frictionally engage the circumference of the pole stand 20 where the clamp 62 and the pole stand 20 come into contact. In alternate embodiment there may be two adjustable tightening means 65 used, one per jaw 69 so as to drive both of the jaws together simultaneously.

The clam 62 has a generally planar disk-like configuration. Its narrowest width is sizably dimensioned for engagement within the horizontal width of clamp slot 52 formed between the shells' support members 58 and 60. There are cutouts 80 on either side of the vertical slot 21 to accommodate the insertion and removal of the clamp 62 into the clamp slot 52 of the sphere 4. The thickness of the clamp 62 is sized for sliding engagement in the vertical spacing between the support members of the sphere.

The clamp 62 has two pivotable C shaped arms 81 and 82, (FIGS. 10 and 13) each that contain one moveable jaw 69. There is a pivot pin 83 pivotally joining one of the ends of the two arms. The other ends of the arms contact each other and lock via the clamp lock means 87, encircling whatever they have been pivoted about. The clamp lock means 87 in the preferred embodiment is a threaded member (set screw, bolt, arm, etc.) passing through threaded orifices in the non pined ends of the two arms 81 and 82. (FIGS. 8 and 12) However, there is a plethora of mechanical equivalents that could be used to join these two arms, including engageable teeth, ratcheting teeth, expandable tab and slots, depressible buttons and recesses, pins or lock rings and orifices, protrusions and detents, and the equivalents.

Figure 9:
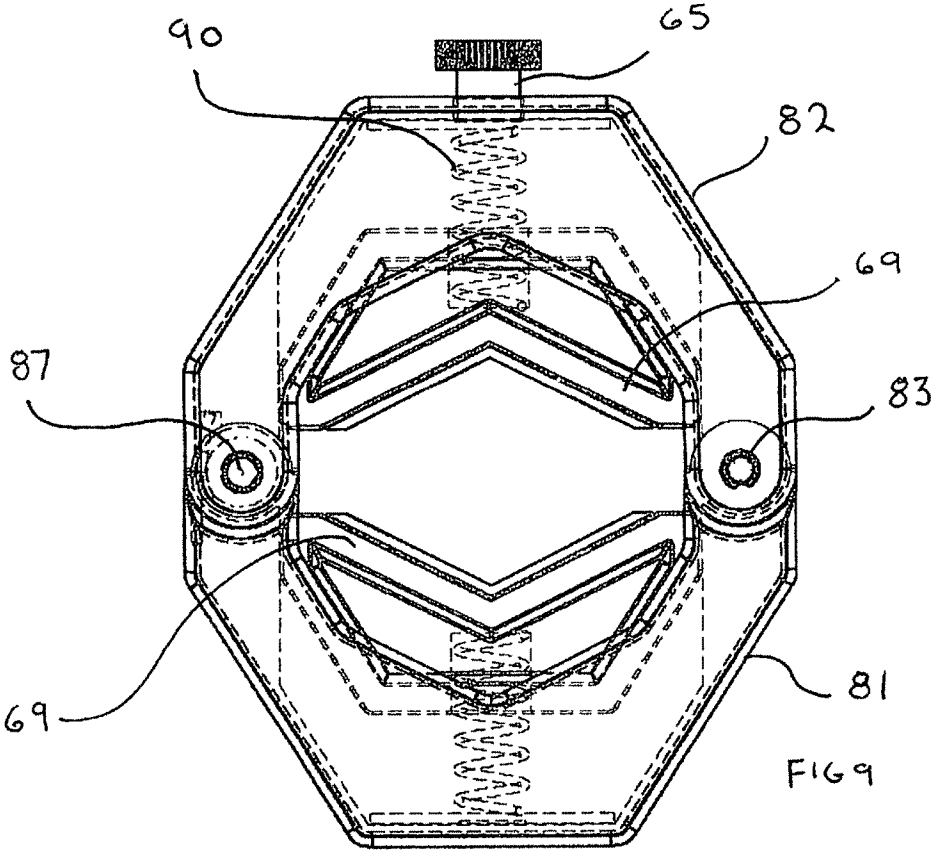
FIG. 9 is a top view of an adjustable pole clamp showing in phantom the adjustable tightening means.
Figure 12:
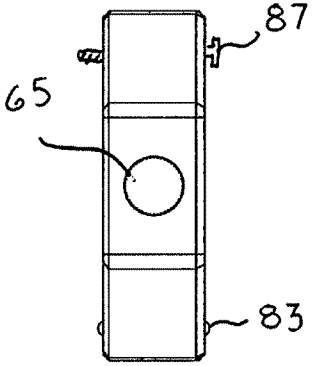
FIG. 12 is a front view of an adjustable pole clamp.
Figure 13:
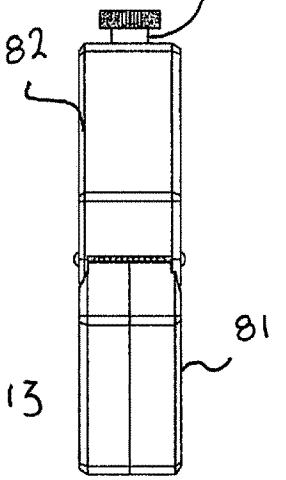
FIG. 13 is a side view of an adjustable pole clamp.
Figure 11:
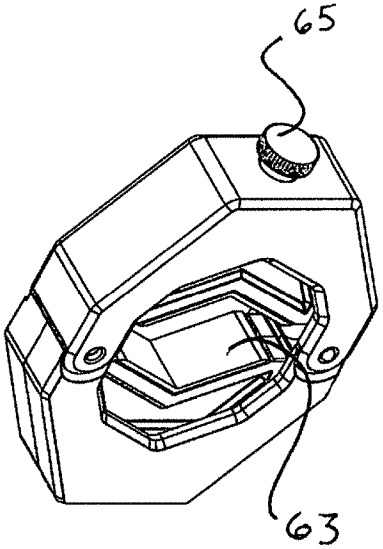
FIGS. 10 and 11 are bottom and top perspectives of an adjustable pole clamp.
Figure 10:
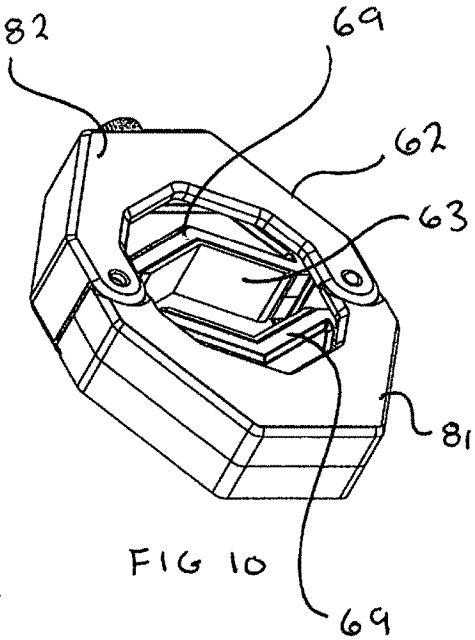

Looking at FIG. 9 one can see that in the preferred embodiment, one of the two Vee shaped jaws 69 is advanced by adjustable tightening means 65 which threadingly advances inward from the outside of the clam arm so as to press against one of the linear compression springs 90, in turn shortening the distance between the two jaws 69. In alternate embodiments this opposable jaw movement may be facilitated by twin adjustable tightening means 65 each utilizing threaded thumbscrews, bolts, set screws or other mechanical devices such as are well known in the art. In other alternate embodiments, at least one of the springs may be eliminated and a vice style spindle or draw bolt with advancing front jaw may be substituted as is well know in the industry.

The clamp 62 may be slid into the vertical slot 52 formed between the support members through the cutouts 80 on the face of the shell 4. The support members 48 and 50 overlap the top and bottom edges of the cutouts 80 so as to extend over the sides of the clamp 62. In the regions of the support members that overlap the clamp 62 there is at least one (preferably two) locking means 61 that frictionally engage the surface of the clamp 62, locking it into the shell 4. The surfaces of the support members that contact the clamp 62 may have a low friction polymer surface treatment or applique to help with decoupling the body of the microphone to the clamp.

Since the purpose of the multichannel head trackable microphone device is to record sound that can be crossfaded for output to simulate what a listener turning their head would hear, (or that to correspond to the video of a panning camera view) the microphone pairs must be separated by sufficient distance to enable their recorded sound to be cross faded by the processor at a level and timing that humans can utilize for sound localization. The opposing microphone pairs (those residing 180 degrees apart on the shell) must have sufficient distance between them such that a minimal interaural time delay of 625 μs can be facilitated. Since the speed of sound (in dry air at 20° C.) is 343 meters per second, the minimum calculated distance for proper separation between opposing pairs of microphones on a spherical shell is 21.4 cm (0.000625 sec×34300 cm/sec). 21.5 cm is the average distance between human ears and the depth of the average human adult ear canal is 2.7 cm. This 21.4 cm calculated separation however, is reduced on the multichannel head trackable microphone 2 by the inclusion of a baffle 50 and its disc 48. In the preferred embodiment the minimum centerline diameter of the shell is 15.24 cm (6 inches).

However, it is known with modified designs of the baffles 50, the discs 48 and the shell's surface (including their surface treatment and materials of construction) it may be possible to reduce this diameter to 10 cm (approximately four inches.)

In alternate embodiments, there may also be an internal or external microphone output adapter solution to allow use of the microphone with either a consumer "plug in power" style unbalanced recording device input, or a professional 48 volt phantom powered recording device input.

In alternate embodiments, an optional plate locking system could be added to the top or bottom of the microphone 2 for attaching to camera tripods that won't allow for attachment via traditional clamps. Furthermore, the processing means associated with the present invention device may also have one or more of the following optional executable steps: A means to process additional audio paths beyond the 8 channels previously described, or fewer audio paths, a means to decode Ambisonic audio paths in all formats, a means to render decoded Ambisonic audio via binaural HRTF modeling filters, and also a means to apply equalization, aural excitement, frequency specific, synthesis and or other digital signal processing to the audio paths to simulate elevation for use with head tracking elevation data received by a 360 video player or virtual reality application or headset.

These components are connected as follows: The microphones are attached to the exterior of the shell 4. The clamp 62 is attached to the support members 58 or 60 of the shell 4. The exterior access door 22 is attached to the exterior of the shell 4. The microphones are connected to the microphone output connections. Each baffles 50 is connected to the outside of the shell 4 separating the microphones. (Each baffle 50 is adjacent to two microphones.) The upper lid 12 attaches to the top of the shell 4. A microphone output adapter can either be inserted between the microphones and some or all of the microphone output connections, or if external it can be connected to some or all of the external microphone output connections, and then connected to the microphone cables that lead to any external recording devices.

For operational purposes, the first pair 24 of microphones 36 and 38 are positioned to capture a forward perspective, the second pair 26 of microphones 44 and 46 are positioned to capture the right perspective, the third set 28 of microphones 40 and 42 are postponed to capture the rear perspective, and the fourth pair 30 of microphones 32 and 34 are positioned to capture the left perspective.

The microphone output connections, in this case 8, but could be more or less than 8 (typically but not limited to ⅛" female tip ring sleeve style connections, or professional XLR style connections). On the alternate embodiment, these are located on both the first, top inner support member 58 and on the second, bottom inner support member 60. In the preferred embodiment they are all on the second, bottom inner support member 60 of the shell 4 for connecting the microphone outputs to a singular or to multiple external audio recording devices. (The four top and four bottom connections can be mirrored for ease of setup as only four stereo outputs are required at one time). The four small baffles separating the microphones, as follows: a baffle 50 is placed between the left front perspective microphone and right rear perspective microphone, a baffle 50 is placed between the right front perspective microphone and the left rear perspective microphone, a baffle 50 is placed between the left left perspective microphone and right right perspective microphone, and the last baffle 50 is placed between the left right perspective microphone and right left perspective microphone.

With respect to the software, in its most complete and preferred version, it is made up of the following executable steps: monitoring real time incoming head tracking positional data from 360 video players, or virtual reality applications and headsets, applying that data to the recorded audio from the multichannel head trackable microphone 2, rendering the appropriate audio perspective for the user based on the positional data in real time, and applying the correct amplitude ratios, or crossfading between the four different audio perspectives to output one continuously changing stereo audio output that correlates to the correct head position of the 360 video or virtual reality end user.

The most complete form of performing the method associated with the present invention device consists of the following steps: attaching the multichannel head trackable microphone 2 to a pole stand 20 via its clamp 62 by opening the external door 22 to access the clamp 62; opening the clamp arms and encircling a pole stand with the clamp jaws; locking together the clamp arms with the clamp lock means; advancing the jaws together around the pole stand with the adjustable tightening means; sliding the clamp 62 into the horizontal slot 52 and attaching the clamp 62 to at least one support member by the locking means; closing the door 22 to complete the attachment; connecting the multichannel microphone 2 to a multichannel recording device, or to multiple recording devices; recording live sound from the environment the multichannel microphone is positioned near to the external recording device or devices; exporting the recorded audio from the recording devices and imported it into a common commercial 360 video or virtual reality computer rendering application; pairing the audio with the multichannel microphone's rendering software, or plugin, so that the audio can be rendered, crossfaded or correlated to the positional data that will be received by the 360 video or virtual reality computer rendering application from the final production container, such as a 360 or virtual reality video player, application, middleware gaming engine, or virtual reality headset.

It should further be noted that, at the conclusion of these steps in the case of a 360 video or virtual reality production, you would now have head-trackable sound that will correlate to the 360 degree head-trackable video within a video payer or virtual reality application. Upon auditioning the content through a 360 video player or virtual reality headset, when you move your head to the left, the sounds originally on the left when you were looking forward will now appear to sound like they are right in front of you. Similarly when you move your head to the right, the sounds originally on the right when you were looking forward will now appear to sound like they are right in front of you. This applies to the full 360 degrees of the horizon, including the view points of front, left, rear, right, and all points in between all of those perspectives.

While the present invention has been described above in terms of specific embodiments, it is to be understood that the invention is not limited to these disclosed embodiments. The present invention is unique in that it is structurally different from other known devices or solutions. More specifically, the present invention is unique due to the presence of: (1) an external door that allows access to the inside of the microphone housing; (2) an internal, size adjustable clamp that allows the microphone to easily be attached to multiple sized stands or mounts; and (3) the option for multiple sets of mirrored microphone outputs on the top and bottom of the microphone housing to allow for flexible connection options to external recording devices including but not limited to both consumer "plug in power" style recording devices such as GoPro cameras, DSLRs, or other portable consumer recorders, and also professional 48 volt phantom power based balanced XLR input style devices. This microphone could also have the following options: Internal DSP, microphone preamplifiers, single and multi-band limiters, adjustable attenuation pads, analogue to digital converters, a hard drive or removable SD card, digital input and output connections, and a level, protractor, and compass for calibration to cameras, and wired or wireless network connectivity such as WiFi or Bluetooth.

Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A 360 degree recording microphone apparatus, comprising:

a shell having the geometric configuration of a convex cylinder having a centerline with a centerline diameter at an exterior surface of said shell, said shell having an open proximal end and an open distal end, and said shell defining an interior volume;

a vertical cutout extending between said proximal end and said distal end of said shell;

at least four discs on said exterior surface of said shell;

at least eight microphones, arranged in pairs of a first and second microphone on each of said discs;

at least four baffles each extending normally from one of each of said discs;

a removable, convex door matingly conformed to said vertical cutout;

a first and second inner support member housed in said interior volume, said support members defining a horizontal slot there between that is located within said interior volume of said shell;

a removeable adjustable clamp, matingly proportioned for sliding engagement within said horizontal slot; and at least one microphone output connector located on a said inner support and in operational contact with said microphones.

2. The 360 degree recording microphone apparatus of claim 1, wherein said centerline diameter of said shell has a minimum diameter of 4 inches.

3. The 360 degree recording microphone apparatus of claim 1 wherein said microphones are chosen from a set of audio microphones having polar patterns selected from any of the set omnidirectional, cardioid, subcartiod, hypercartoid, supercartiod, shotgun or bidirectional polar patterns.

4. The 360 degree recording microphone apparatus of claim 1 wherein said microphones are positioned along said centerline in four substantially similar microphone pairs of a first and second microphone.

5. The 360 degree recording microphone apparatus of claim 1 wherein said microphone pairs are positioned at 90 degrees apart from adjacent said microphone pairs.

6. The 360 degree recording microphone apparatus of claim 1 wherein said four discs are arranged along said centerline of said shell.

7. The 360 degree recording microphone apparatus of claim 1 wherein said baffles are positioned centrally between each first and second microphone.

8. The 360 degree recording microphone apparatus of claim 1 wherein said clamp has two moveable and opposable Vee shaped members.

9. The 360 degree recording microphone apparatus of claim 1 further comprising a removeable top concave partial lid, said lid matingly conformed to said open proximal end.

10. The 360 degree recording microphone apparatus of claim 1 further comprising a removeable bottom concave partial lid, said lid matingly conformed to said open distal end.

11. The 360 degree recording microphone apparatus of claim 1 wherein the number of microphone output connectors is eight, and the number of inner support members is two; wherein each said support member houses four of said microphone output connectors.

12. The 360 degree recording microphone of claim 1 wherein said baffles are arced and are made of low durometer polymer material having a durometer in the range of 30 to 70 on the Shore 00 Durometer Hardness Scale.

13. The 360 degree recording microphone of claim 1 wherein said shell has a matte finish on said exterior surface.

14. A 360 degree recording microphone apparatus, comprising:

a shell having the geometric configuration of a convex cylinder having a horizontal centerline, said shell having an open proximal end and an open distal end, and said shell defining an interior volume;

a vertical cutout extending between said proximal end and said distal end of said shell;

at least eight microphones, arranged on the outside surface of said shell;

at least one inner support member housed in said interior volume, said support member defining an exterior accessible horizontal slot there between;

a removeable, size adjustable clamp, matingly proportioned for sliding engagement within said horizontal slot; and at least one microphone output connector operatively connected to said microphones and located on at least one of said inner support members.

15. The 360 degree recording microphone apparatus, of claim 14 wherein said microphones are positioned about said horizontal centerline of said shell in pairs of a first and second microphone.

16. The 360 degree recording microphone apparatus, of claim 15 further comprising at least four baffles each one positioned adjacent both first and second microphone.

17. The 360 degree recording microphone apparatus, of claim 16 wherein said microphone pairs are positioned at 90 degrees apart from each of adjacent said microphone pairs.

18. The 360 degree recording microphone apparatus of claim 17 further comprising a clamp lock means situated on at least one of the inner support members, said clamp lock means extending between said clamp and said inner support members for frictional engagement of said clamp within said horizontal slot.

* * * * *